US008310169B2

(12) United States Patent
Yu

(10) Patent No.: US 8,310,169 B2
(45) Date of Patent: Nov. 13, 2012

(54) POWER CONVERSION DRIVING CIRCUIT AND FLUORESCENT LAMP DRIVING CIRCUIT

(75) Inventor: Chung-Che Yu, Taipei County (TW)

(73) Assignee: Green Solution Technology Co., Ltd., New Taipei (TW)

( * ) Notice: Subject to any disclaimer, the term of this patent is extended or adjusted under 35 U.S.C. 154(b) by 379 days.

(21) Appl. No.: 12/829,363

(22) Filed: Jul. 1, 2010

(65) Prior Publication Data

US 2011/0037401 A1 Feb. 17, 2011

(30) Foreign Application Priority Data

Aug. 13, 2009 (TW) ..... 98127316 A

(51) Int. Cl.

| | |
|---|---|
| ***H05B 41/16*** | (2006.01) |
| ***H05B 41/24*** | (2006.01) |
| ***H05B 41/36*** | (2006.01) |
| ***H05B 37/00*** | (2006.01) |
| ***H05B 39/00*** | (2006.01) |

(52) U.S. Cl. ..... 315/246; 315/173; 315/209

(58) Field of Classification Search ..... 315/246, 315/57, 70, 97, 105, 156, 172, 177, 186, 315/194, 209

See application file for complete search history.

(56) References Cited

U.S. PATENT DOCUMENTS

| | | | | |
|---|---|---|---|---|
| 2004/0114400 | A1* | 6/2004 | Shinba | 363/56.02 |
| 2007/0146951 | A1* | 6/2007 | Takahashi et al. | 361/93.1 |
| 2010/0315017 | A1* | 12/2010 | Yu et al. | 315/291 |
| 2012/0139342 | A1* | 6/2012 | Bailey et al. | 307/31 |

* cited by examiner

*Primary Examiner* — Shawki Ismail
*Assistant Examiner* — Dylan White
(74) *Attorney, Agent, or Firm* — Jianq Chyun IP Office

(57) ABSTRACT

A power conversion driving circuit is provided. The power conversion drive circuit includes a converting circuit, a control circuit and a load circuit. The converting circuit is coupled to an input voltage. The control circuit is coupled to the converting circuit for controlling the converting circuit to convert the input voltage to an output voltage. The load circuit includes a load detecting unit and a load. The load is coupled to the output voltage, and the load detecting unit is coupled to a detecting voltage source. The load detecting unit generates a load detecting signal to re-start the control circuit when the load circuit is inserted into the power conversion driving circuit.

24 Claims, 6 Drawing Sheets

POWER CONVERSION DRIVING CIRCUIT AND FLUORESCENT LAMP DRIVING CIRCUIT

CROSS-REFERENCE TO RELATED APPLICATION

This application claims the priority benefit of Taiwan application serial no. 098127316, filed on Aug. 13, 2009. The entirety of the above-mentioned patent application is hereby incorporated by reference herein and made a part of this specification.

BACKGROUND OF THE INVENTION

1. Field of the Invention

The invention generally relates to a power conversion driving circuit, and more particularly, to a power conversion driving circuit having the function of automatically turning off and re-starting.

2. Description of Related Art

Current power supplies are mainly classified into linear power supplies (LPS) and switching power supplies (SPS). The LPS has a simple circuit, small ripples, and less electromagnetic interference (EMI). However, electric devices in the circuit are large, so that the volume of the circuit is large, and the weight thereof is heavy, and further, conversion efficiency thereof is low. On the contrary, even though the SPS has a more complex circuit, larger ripples, and more EMI, the SPS is still mainstream in the market of power supplies since it has higher conversion efficiency and less power consumption while idling.

FIG. 1A is a schematic circuit of an SPS configured to drive a lamp in a related art. Referring to FIG. 1A, The SPS includes an initial resistor R, an initial capacitor C2, a Zener diode Z, a controller CON, a high-side driving capacitor C1, a high-side driving transformer T1, a high-side transistor switch M1, a low-side transistor switch M2, a diode D, an output capacitor C3, and a transformer T2. The SPS is configured to convert a DC input voltage VIN to an AC output voltage VOUT to drive a lamp LAMP.

When the DC input voltage is inputted, a current is supplied to the initial capacitor C2 through the initial resistor R, so that a voltage drop across the initial capacitor C2 is raised until it is equal to the breakdown voltage of the Zener Diode Z. The initial capacitor C2 generates a driving voltage VDD to supply the electric power required for operating to the controller CON. When the driving voltage VDD is higher than a start voltage of the controller CON, the controller CON is started, so as to generate control signals to control the high-side transistor switch M1 and the low-side transistor switch M2. The controller CON raises a voltage level of the control signal up to a suitable voltage level to control the high-side transistor switch M1 through the high-side driving capacitor C1 and the high-side driving transformer T1. By switching the high-side transistor switch M1 and the low-side transistor switch M2, the electric power of the DC input voltage VIN is transmitted to an output terminal to generate the AC output voltage VOUT to drive the lamp LAMP. The transformer T2 is coupled to the AC output voltage VOUT, and transmits electric power, rectified by the diode D, to the initial capacitor C2.

The initial capacitor C2 gradually stores the electric power due to the fact that the electric power transmitted through the initial resistor R is more than the electric power consumed by the controller CON before the controller CON is started. After the controller CON is started, the electric power through the transformer T2 and the diode D is also supplied to the controller CON. Accordingly, the initial resistor R having a relatively large resistance is used to lower power consumption by the initial resistor R. However, when an abnormal event occurs in the circuit, no more electric power from the DC input voltage VIN is supplied to the to the AC output voltage VOUT, so that the transformer T2 and the diode D can not supply the electric power any more. Moreover, the electric power transmitted through the initial resistor R is not enough to provide all of the electric power required by the controller CON while normally operating, so that the operation of the controller CON may fail.

FIG. 1B illustrates a schematic signal waveform of the SPS configured to drive the lamp in the related art while the circuit stays in the abnormal state. Referring to FIG. 1B, when the driving voltage VDD is higher than the start voltage UVLO, the SPS starts to operate. At this time, since an oscillator and a control circuit inside the controller CON have started to operate, the current consumed thereby is much more than the current supplied by the DC input voltage VIN through the resistor R. Accordingly, the driving voltage may start to fall down. When the circuit operates at a normal state, the controller CON outputs signals to switch the high-side transistor switch M1 and the low-side transistor switch M2, so that the AC output voltage VOUT is raised, and the electric power is supplied to the initial capacitor C2 through the transformer T2 and the diode D. However, when an abnormal event occurs in the circuit, the controller CON stops switching the high-side transistor switch M1 and the low-side transistor switch M2, so that the AC output voltage VOUT is lowered and can not supply the electric power to the driving voltage VDD. As a result, the driving voltage VDD still falls down. When the driving voltage VDD has become lower than a voltage range which the controller CON can operate, the controller CON stops operating and further decreases the consuming power. Accordingly, the driving voltage VDD is raised again until it is higher than the start voltage UVLO, so that the controller CON is re-started. The above-described cycle is repeated until the abnormal event is eliminated. Furthermore, in order to avoid an erroneous judgment that the lamp does not light due to a temporary abnormal event, the controller CON may try to strike the lamp continuously when the lamp does not light in the related art. In the process, not only is life-span of the lamp shortened due to limitation of start cycles thereof, but also users may get an electric shock during lamp replacing if the users forget to turn off the power source. Moreover, if the users turn off the power source first, and next turn on the power source after the lamp has been replaced with new one, the users may not get the electric shock during lamp replacing, but it is not convenient for the users and is different from the normal users' habits.

Accordingly, even though the lamp driving circuit may re-start the lamp in the SPS of the related art, not only is the life-span of the lamp shortened, but also using it may be dangerous to the users.

SUMMARY OF THE INVENTION

Accordingly, an embodiment of the invention provides a power conversion driving circuit. The power conversion driving circuit is turned off when the load driven thereby is removed. Therefore, the power consumption by the control circuit is reduced when the abnormal state occurs in the power conversion driving circuit, and the danger to users is also avoided when they use the power conversion driving circuit. Moreover, after load replacing, the power conversion driving circuit is automatically re-started to increase users' convenience.

An embodiment of the invention provides a power conversion driving circuit. The power conversion driving circuit includes a converting circuit, a control circuit, and a load circuit. The converting circuit is coupled to an input voltage. The control circuit is coupled to the converting circuit and is configured to control the converting circuit to convert the input voltage to an output voltage. The load circuit includes a load detecting unit and a load. The load is coupled to the output voltage, and the load detecting unit is coupled to a detecting voltage source. Wherein, the load detecting unit generates a load detecting signal to re-start the control circuit when the load circuit is inserted into the power conversion driving circuit.

As a result, by inserting the load circuit into the power conversion driving circuit, the capability to automatically re-start the power conversion driving circuit is reached.

Another embodiment of the invention provides a power conversion driving circuit. The power conversion driving circuit includes a converting circuit, a control circuit, and a load circuit. The converting circuit is coupled to an input voltage. The control circuit is coupled to the converting circuit and is configured to control the converting circuit to convert the input voltage to an output voltage. The load circuit includes a load detecting unit and a load. The load is coupled to the output voltage, and the load detecting unit is coupled to a driving voltage source. Wherein, the control circuit is coupled to the driving voltage source to receive electric power therefrom through the load detecting unit, and the electric power from the driving voltage source is stopped from being provided when the load circuit is removed.

Another embodiment of the invention provides a driving circuit of a fluorescent lamp. The driving circuit of a fluorescent lamp includes a converting circuit, a control circuit, and a load circuit. The converting circuit is coupled to an input voltage. The control circuit is coupled to the converting circuit and is configured to control the converting circuit to convert the input voltage to an output voltage. The load circuit includes a load detecting unit and the fluorescent lamp, wherein the fluorescent lamp is coupled to the output voltage and has two filaments. The load detecting unit is coupled to the input voltage and a ground voltage through the two filaments and generates a load detecting signal. The control circuit stops operating when an abnormal state occurs in the driving circuit of the fluorescent lamp, and next, the control circuit is re-started when detecting that the load detecting signal enters a predetermined voltage range.

As a result, the electric power required for operating is stopped from being provided when the load circuit is removed, so that the control circuit is turned off due to the insufficiency of driving voltage. Accordingly, the power consumption by the control circuit is reduced. Moreover, when the load circuit is inserted again, the electric power required for operating is provided again. Therefore, the control circuit is automatically re-started, so that the capability to automatically re-start the power conversion driving circuit is also reached.

It is to be understood that both the foregoing general description and the following detailed description are exemplary, and are intended to provide further explanation of the invention as claimed. In order to make the features and the advantages of the invention comprehensible, exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1A:
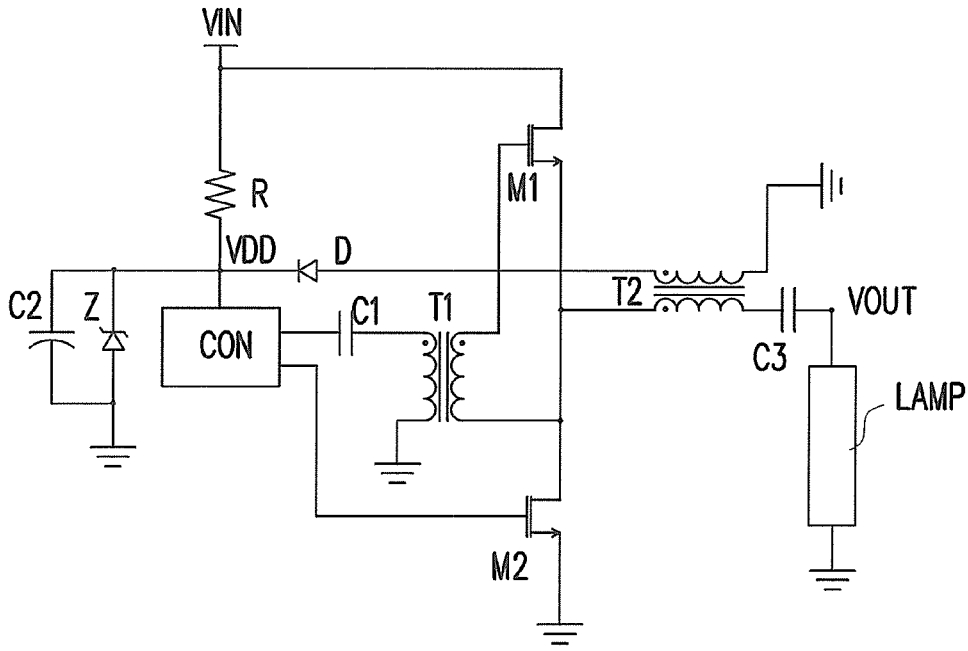
FIG. 1A (RELATED ART)
FIG. 1A is a schematic circuit of a SPS configured to drive a lamp in a related art.
Figure 1B:
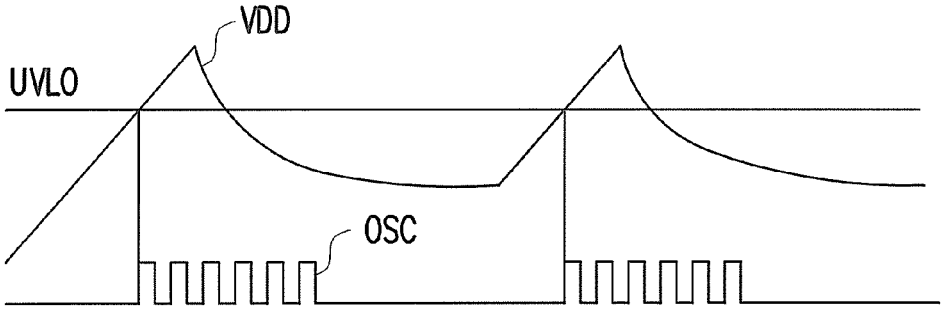
FIG. 1B (RELATED ART)
FIG. 1B illustrates a schematic signal waveform of the SPS configured to drive the lamp in the related art while the circuit stays in the abnormal state.
Figure 2:
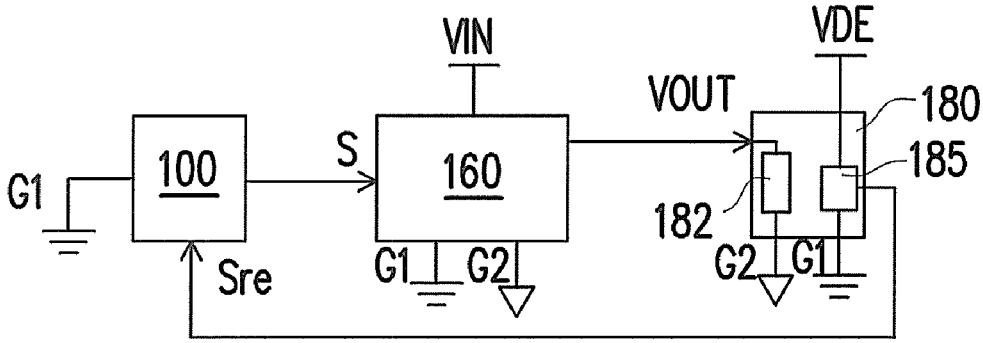
FIG. 2 is a circuit block diagram of a power conversion driving circuit according to an embodiment consistent with the invention.

FIG. 2 is a circuit block diagram of a power conversion driving circuit according to an embodiment consistent with the invention. Referring to FIG. 2, the power conversion driving circuit includes a control circuit 100, a converting circuit 160, and a load circuit 180. The converting circuit 160 is coupled to an input voltage VIN. The control circuit 100 is coupled to the converting circuit 160 and generates a control signal S to control the converting circuit 160 to convert the input voltage VIN to an output voltage VOUT. The load circuit 180 includes a load 182 and a load detecting unit 185. The load 182 is coupled to the output voltage VOUT, and the load detecting unit 185 is coupled to a driving voltage source VDE. The driving voltage source VDE may be the input voltage VIN, the output voltage VOUT, or one of other voltage sources which can provide electric power. Wherein, the load detecting unit 185 generates a load detecting signal Sre when being coupled to the driving voltage source VDE. Accordingly, when the load circuit 180 is inserted into the power conversion driving circuit, the control circuit 100 can be re-started by the load detecting signal Sre generated by the load detecting unit 185.

It should be noted that, the power conversion driving circuit in the embodiment of the invention can provide electrical isolation to satisfy safety regulations. Referring to FIG. 2, one terminal of the converting circuit 160 is coupled to the input voltage VIN and a first common voltage level G1, and the other terminal of the converting circuit 160 generates the output voltage VOUT after conversion. Moreover, the other terminal thereof is coupled to a second common voltage level G2. One terminal of the load receives the output voltage VOUT, and the other terminal thereof is coupled to the second common voltage level G2. The control circuit 100 and the load detecting unit 185 are coupled to the first common voltage level G1. The load 182 and the load detecting unit 185 in the load circuit 180 are not directly connected to each other, and each of them is coupled to the corresponding common voltage level, so that the electrical isolation is achieved. Obviously, if the electrical isolation is not required in practice, the load 182 and the load detecting unit 185 can be connected to each other.

Figure 3:
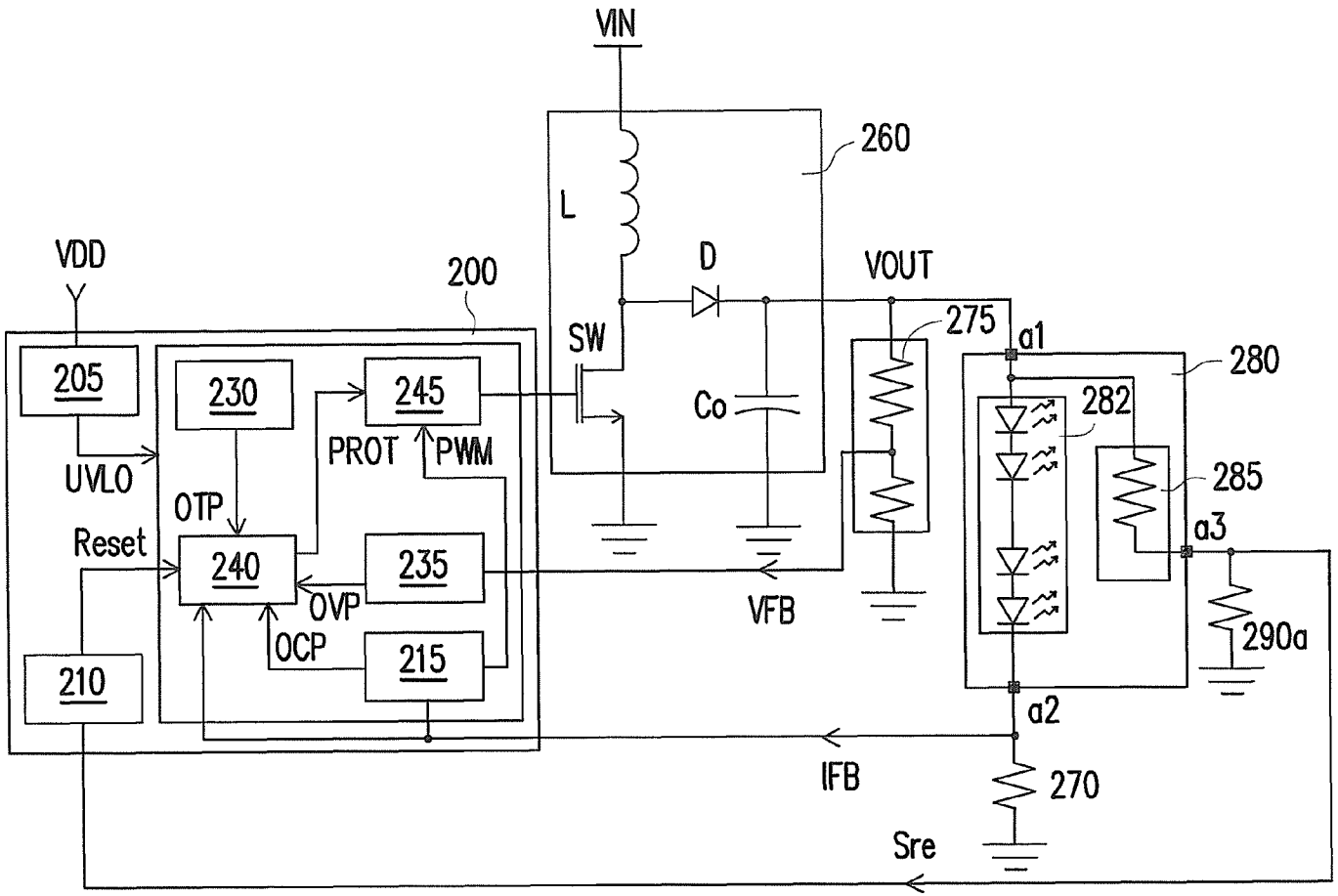
FIG. 3 is a schematic circuit of a power conversion driving circuit according to a first embodiment consistent with the invention.

FIG. 3 is a schematic circuit of a power conversion driving circuit according to a first embodiment consistent with the invention. Referring to FIG. 3, the power conversion driving circuit includes a control circuit 200, a converting circuit 260, and a load circuit 280. The converting circuit 260 is a boost DC/DC converting circuit including an inductor L, a diode D, a switch SW, and an output stabilizing capacitor Co. The converting circuit 260 is configured to receive an input voltage VIN and converts the received input voltage VIN up to the output voltage VOUT. The load circuit 280 includes a light emitting diode (LED) module 282 and a load detecting unit 285. The LED module 282 is coupled to the converting circuit 260 to receive the output voltage VOUT through a first connecting terminal a1 of the load circuit 280, and the LED module 282 is grounded through a second connecting terminal a2 of the load circuit 280. The load detecting unit 285 includes a resistor. One terminal of the resistor is coupled to the converting circuit 260 through the first connecting terminal a1, so that the output voltage VOUT serves as a detecting voltage source. The other terminal of the resistor is coupled to the ground from a third connecting terminal a3 of the load circuit 280 through a resistor 290*a*, so as to generate a load detecting signal Sre.

The control circuit 200 includes an under voltage lock-out unit 205, a re-starting unit 210, a current feedback unit 215, an over temperature protection unit 230, a voltage feedback unit 235, a protection unit 240, and a driving signal generating unit 245. The control circuit 200 is configured to generate a control signal to control the switch SW in the converting circuit 260. The under voltage lock-out unit 205 is coupled to a driving voltage VDD and generates a starting signal UVLO to the other circuit units in the control circuit 200 when the driving voltage VDD has reached to a predetermined operation voltage, so that the other circuit units start to work.

The power conversion driving circuit includes a current detecting circuit 270 and a voltage detecting circuit 275. Wherein, the current detecting circuit 270 is coupled to the load circuit 280 to detect a load current flowing through the LED module 282 and to generate a current detecting signal IFB. The voltage detecting circuit 275 is coupled to the converting circuit 260 to detect the output voltage VOUT and to generate a voltage detecting signal VFB. The current feedback unit 215 receives the current detecting signal IFB to generate a pulse width modulation signal PWM, and the current feedback unit 215 generates an over current protection signal OCP when the load current is higher a predetermined maximum current. The voltage feedback unit 235 receives the voltage detecting signal VFB and generates an over voltage protection signal OVP when the output voltage VOUT is higher than a predetermined maximum voltage. The over temperature protection unit 230 detects the temperature of the LED module 282 and generates an over temperature protection signal OTP when the temperature is higher than a predetermined maximum temperature. The protection unit 240 is coupled to the current feedback unit 215, the over temperature protection unit 230, a voltage feedback unit 235, and the current detecting circuit 270. When receiving any one of the over current protection signal OCP, the over voltage protection signal OVP, and the over temperature protection signal OTP, the protection unit 240 generates a protecting signal PROT to the driving signal generating unit 245 to stop the driving signal generating unit 245 generating the control signal. The driving signal generating unit 245 receives the pulse width modulation signal PWM and accordingly modulates duty cycle of the control signal to control the amount of the electric power transmitted from the input voltage VIN into the converting circuit 260. As a result, the load current flowing through the LED module 282 is stabilized around a predetermined current value, and further, the LED module 282 stably emits light. When receiving the protecting signal PROT, the driving signal generating unit 245 instantly stops outputting the control signal until it does not receive the protecting signal PROT. If the abnormal state occurs in the circuit and so the protection unit 240 constantly receives the over current protection signal OCP or the over voltage protection signal OVP for a predetermined period, or the current detecting signal IFB is zero for a predetermined period (i.e. the load current is zero for the predetermined period), the protection unit 240 generates and constantly outputs the protecting signal PROT to stop the control circuit 200 controlling the converting circuit 260. That is, the protection unit 240 latches the control circuit 200 in a protection mode until the control circuit 200 is re-started.

When the abnormal state occurs in the load 282, it causes the control circuit 200 to stop outputting the control signal. Accordingly, the output voltage VOUT gradually falls down because of the leakage current of the circuit. When the output voltage VOUT is lower than the input voltage VIN, the diode D is turned on. At this time, the output voltage VOUT is thus maintained at a voltage which is lower than the input voltage VIN by a forward bias voltage of the diode D. The re-starting unit 210 is coupled to the load detecting unit 285 to receive the load detecting signal Sre. Because the load detecting unit 285 is built inside the load circuit 280, when the abnormal state occurs in the load 282, and the user removes the load circuit 280 for replacing, the load detecting unit 285 is also removed along with the load circuit 280. At this time, due to the resistor 290*a*, the load detecting signal Sre is at a low voltage level, and the re-starting unit 210 enters a pre-restarting state. When a new load circuit is inserted into the power conversion driving circuit, the third connecting terminal a3 is coupled to the output voltage VOUT through the load detecting unit 285 again. Accordingly, when the new load circuit has been inserted into the power conversion driving circuit, the load detecting signal Sre is raised above a re-starting voltage level again. At this time, the re-starting unit 210 outputs a re-starting signal Reset to release a protection mode of the protection unit 240, so that the control circuit 200 is re-started.

Figure 4:
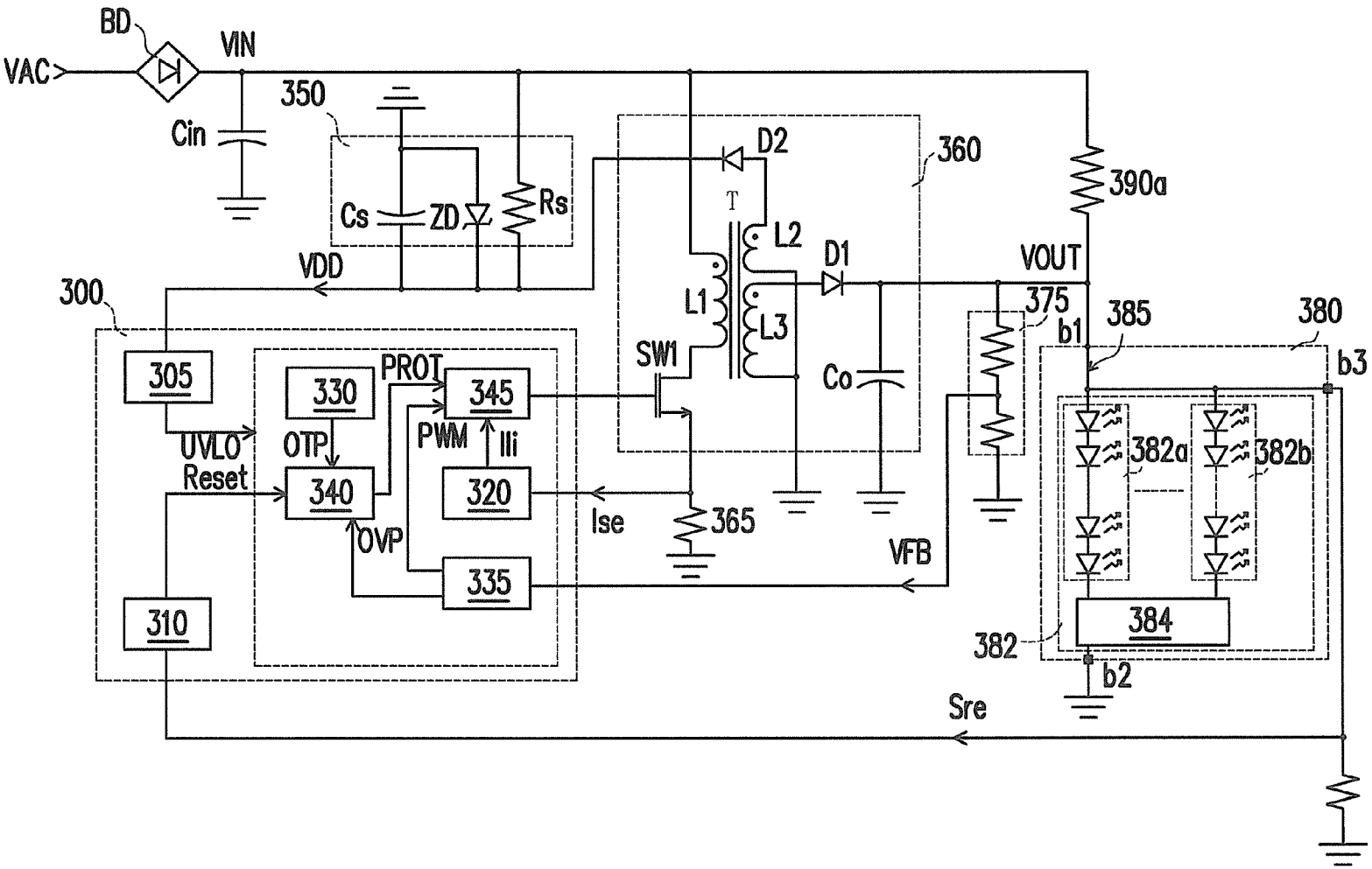
FIG. 4 is a schematic circuit of a power conversion driving circuit according to a second embodiment consistent with the invention.

FIG. 4 is a schematic circuit of a power conversion driving circuit according to a second embodiment consistent with the invention. Referring to FIG. 4, the power conversion driving circuit includes a control circuit 300, a converting circuit 360, and a load circuit 380. The converting circuit 360 is a flyback voltage converting circuit including a transformer T, a first diode D1, a second diode D2, a switch SW1, and an output capacitor Co. The converting circuit 360 is configured to receive an input voltage VIN and converts the received input voltage VIN up to the output voltage VOUT. The input voltage VIN is generated by rectifying a voltage from an AC voltage source VAC through a bridge rectifier BD and then stabilizing the rectified voltage through an input capacitor Cin. The transformer T has a primary coil L1, a secondary coil L3, and an auxiliary coil L2. One terminal of the primary coil L1 is coupled to the input voltage VIN, and the other terminal of the primary coil L1 is coupled to the switch SW1. The secondary coil L3 is coupled to the first diode D1, so that the converted voltage from the secondary coil L3 is rectified through the first diode D1 and then stabilized through the output capacitor Co. Accordingly, the output voltage VOUT is formed. The auxiliary coil L2 transmits a part of energy stored in the transformer T to the control circuit 300 through the second diode D2.

The load circuit 380 includes an LED module 382 and a load detecting unit 385. The LED module 382 includes a plurality of LED strings 382*a* and 382*b* and a current-balancing circuit 384. The current-balancing circuit 384 is coupled to the plurality of LED strings 382*a* and 382*b*, so that the current flowing through the LED strings 382*a* and 382*b* is uniform. Moreover, the current-balancing circuit 384 is grounded through a second connecting terminal b2 of the load circuit 380. In the present embodiment, the load detecting unit 385 is a wire connecting a first connecting terminal b1 and a third connecting terminal b3 of the load circuit 380. The resistance of the wire is almost zero. One terminal of the load detecting unit 385 is coupled to the input voltage VIN through a resistor 390*a*, and the other terminal of the load detecting unit 385 generates the load detecting signal Sre.

The power conversion driving circuit includes an input starter 350 to receive the input voltage VIN, converts the received input voltage VIN to a driving voltage VDD, and then outputs the converted driving voltage VDD to the control circuit 300. The input starter 350 includes a start capacitor Cs, a Zener Diode ZD, and a start resistor Rs. The control circuit 300 includes an under voltage lock-out unit 305, a re-starting unit 310, a current-limiting unit 320, an over temperature protection unit 330, a voltage feedback unit 335, a protection unit 340, and a driving signal generating unit 345. The control circuit 300 is configured to generate a control signal to control the switch SW1 in the converting circuit 360. The under voltage lock-out unit 305 is coupled to a driving voltage VDD and generates a starting signal UVLO to the other circuit units in the control circuit 300 when the driving voltage VDD has reached to a predetermined start voltage, so that the other circuit units start to work.

The power conversion driving circuit includes a voltage detecting circuit 375 and a current-limiting resister 365. The current-limiting resister 365 is coupled to the switch SW1 in the converting circuit 360 and generates a current signal Ise according to the amount of the current flowing through the switch SW1. The current-limiting unit 320 receives the current signal Ise and generates a current-limiting signal Ili to the driving signal generating unit 345 when the current flowing through the switch SW1 is larger than a current-limiting value. The voltage detecting circuit 375 is coupled to the converting circuit 360 to detect the output voltage VOUT and generates a voltage detecting signal VFB. The voltage feedback unit 335 receives the voltage detecting signal VFB to generate a pulse width modulation signal PWM, and the voltage feedback unit 335 generates an over voltage protection signal OVP when the output voltage VOUT is higher than the predetermined maximum voltage. The over temperature protection unit 330 detects the temperature of the LED module 382 and generates an over temperature protection signal OTP when the temperature is higher than the predetermined maximum temperature. The protection unit 340 is coupled to the over temperature protection unit 330 and the voltage feedback unit 335. When receiving any one of the over voltage protection signal OVP and the over temperature protection signal OTP, the protection unit 340 generates a protecting signal PROT to the driving signal generating unit 345 to stop the driving signal generating unit 345 generating the control signal. The driving signal generating unit 345 receives the pulse width modulation signal PWM and accordingly modulates the duty cycle of the control signal to control the amount of the electric power transmitted from the input voltage VIN into the converting circuit 360. As a result, the output voltage VOUT is stabilized around a predetermined voltage value. When receiving the current-limiting signal Ili during a period of the switch SW1 being turned on, the driving signal generating unit 345 instantly cuts off the switch SW1 to avoid an extremely large current flowing through the switch SW1 until the cycle period terminates. When receiving the protecting signal PROT, the driving signal generating unit 345 instantly stops outputting the control signal until it does not receive the protecting signal PROT. If the protection unit 340 constantly receives the over voltage protection signal OVP for a predetermined period due to that an abnormal state occurs in the circuit, the protection unit 340 constantly outputs the protecting signal PROT to stop the control circuit 300 controlling the converting circuit 360. That is, the protection unit 340 latches the control circuit 300 in the protection mode until the control circuit 300 is re-started.

The re-starting unit 310 is coupled to the load detecting unit 385 to receive the load detecting signal Sre. Because the load detecting unit 385 is built inside the load circuit 380, when the abnormal state occurs in the load 382, and the users removes the load circuit 380 for replacing, the load detecting unit 385 is also removed along with the load circuit 380. At this time, the load detecting signal Sre is at the low voltage level, and the re-starting unit 310 enters the pre-restarting state. When a new load circuit is inserted into the power conversion driving circuit, the load detecting unit 385 is coupled to the input voltage VIN again through the resister 390*a*. Accordingly, when the new load circuit has been inserted into the power conversion driving circuit, the load detecting signal Sre is raised above a re-starting voltage level again. At this time, the re-starting unit 310 outputs a re-starting signal Reset to release protection unit 340 from a protection mode, so that the control circuit 300 is re-started.

Figure 5:
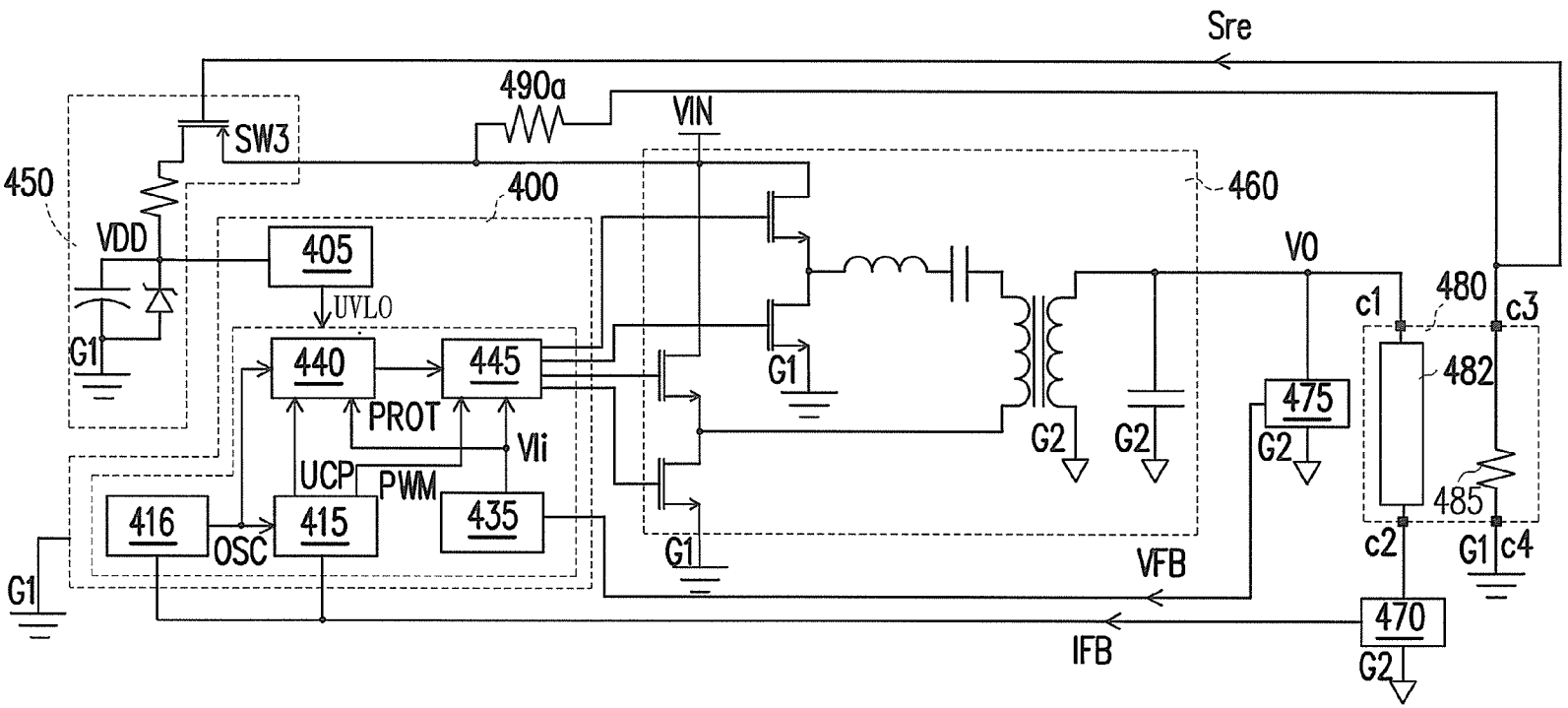
FIG. 5 is a schematic circuit of a power conversion driving circuit according to a third embodiment consistent with the invention.

FIG. 5 is a schematic circuit of a power conversion driving circuit according to a third embodiment consistent with the invention. Referring to FIG. 5, the power conversion driving circuit includes a control circuit 400, a converting circuit 460, and a load circuit 480. The converting circuit 460 is a full-bridge DC/AC converting circuit. The primary side of the converting circuit 460 is coupled to a first common voltage level G1, and the secondary side thereof is coupled to a second common voltage level G2. The converting circuit 460 is configured to convert a DC input voltage VIN to an AC output voltage VO to drive a fluorescent lamp 482 in the load circuit 480. The load circuit 480 includes the fluorescent lamp 482 and a load detecting unit 485. Two terminals of the fluorescent lamp 482 are respectively coupled to the AC output voltage VO and the second common voltage level G2 through a first connecting terminal c1 and a second connecting terminal c2. Two terminals of the load detecting unit 485 are respectively coupled to an input starter 450 and the first common voltage level G1 through a third connecting terminal c3 and a fourth connecting terminal c4, and the load detecting unit 485 generates a load detecting signal Sre. Because the load detecting unit 485 is coupled to the input voltage VIN through a resister 490*a*, when the load circuit 480 is removed, the voltage level of the load detecting signal Sre is raised to the voltage level of the input voltage VIN, and when the load circuit 480 is inserted, the voltage level of the load detecting signal Sre falls down. Moreover, because the common voltage levels to which the fluorescent lamp 482 and the load detecting unit 485 are respectively coupled are different and not directly connected, the fluorescent lamp 482 and the load detecting unit 485 are electrically isolated from each other.

The power conversion driving circuit further includes an input starter 450. The input starter 450 and the control circuit 400 are both coupled to the first common voltage level G1. The input starter 450 receives the input voltage VIN, converts the received input voltage VIN to a driving voltage VDD, and then outputs the converted driving voltage VDD to the control circuit 400. The control circuit 400 includes an under voltage lock-out unit 405, a current feedback unit 415, an oscillation unit 416, a voltage-limiting unit 435, a protection unit 440, and a driving signal generating unit 445. The control circuit 400 is configured to generate control signals to control the switches in the converting circuit 460. The under voltage lock-out unit 405 is coupled to a driving voltage VDD and generates a starting signal UVLO to the other circuit units in the control circuit 400 when the driving voltage VDD has reached to a predetermined start voltage, so that the other circuit units start to operate.

The power conversion driving circuit includes an isolating current detecting circuit 470 and an isolating voltage detecting circuit 475. The isolating current detecting circuit 470 and the isolating voltage detecting circuit 475 may be optical couplers or other devices with electrically isolating function. The isolating voltage detecting circuit 475 is coupled to the fluorescent lamp 482 to detect the amount of the current flowing through the fluorescent lamp 482 and generate a current detecting signal IFB. The isolating voltage detecting circuit 475 is coupled to the converting circuit 460 to detect the amplitude of the AC output voltage VOUT and generates a voltage detecting signal VFB. The oscillation unit 416 receives the current detecting signal IFB and generates an oscillation signal OSC. When the current detecting signal IFB represents that a lamp current is equal to zero, the oscillation unit 416 outputs the oscillation signal OSC having a higher frequency to strike the fluorescent lamp 482; when the current detecting signal IFB represents that a lamp current is larger than zero (it represents that the fluorescent lamp 482 has been struck), the oscillation unit 416 outputs the oscillation signal OSC having a lower frequency. The current feedback unit 415 receives the current detecting signal IFB and the oscillation signal OSC to generate a pulse width modulation signal PWM, and the current feedback unit 415 generates an under lamp current protection signal UCP when the lamp current remains zero for a predetermined period. The voltage-limiting unit 435 receives the voltage detecting signal VFB and generates a voltage-limiting signal Vli when the output voltage VO is higher than the maximum value of a predetermined voltage. The driving signal generating unit 445 receives the pulse width modulation signal PWM and accordingly modulates duty cycles of the control signals to control the amount of the electric power transmitted from the input voltage VIN into the converting circuit 460. As a result, the lamp current is stabilized around a predetermined current value, and when receiving the voltage-limiting signal Vli, the driving signal generating unit 445 is switched to be controlled through voltage feedback, so that the voltage drop across the fluorescent lamp 482 is not too large during lamp striking.

The protection unit 440 is coupled to the current feedback unit 415, the oscillation unit 416, and the voltage-limiting unit 435 and determines whether the under lamp current protection signal UCP or the voltage-limiting signal Vli is constantly generated for a predetermined period. If so, the protection unit 440 constantly generates a protecting signal PROT to the driving signal generating unit 445 to stop the driving signal generating unit 445 generating the control signal. That is, the protection unit 440 latches the control circuit 400 in the protection mode until the control circuit 400 is re-started.

The input starter 450 includes a switch SW3. In the present embodiment, the switch SW3 is a p-type metal-oxide-semiconductor (PMOS) transistor. When the load circuit 480 is removed, the voltage level of the load detecting signal Sre is raised to the voltage level of the input voltage VIN, so that the switch SW3 is turned off. At this time, the driving voltage VDD starts to fall down. When the driving voltage VDD is too low, so that the under voltage lock-out unit 405 does not generate a starting signal UVLO to the other circuit units in the control circuit 400, the control circuit 400 stops operating. When the load circuit 480 is inserted again, the voltage level of the load detecting signal Sre falls down, so that the switch SW3 is turned on. As a result, the driving voltage VDD is raised again, so that the under voltage lock-out unit 405 generates a starting signal UVLO. Accordingly, the control circuit 400 is automatically re-started.

Figure 6:
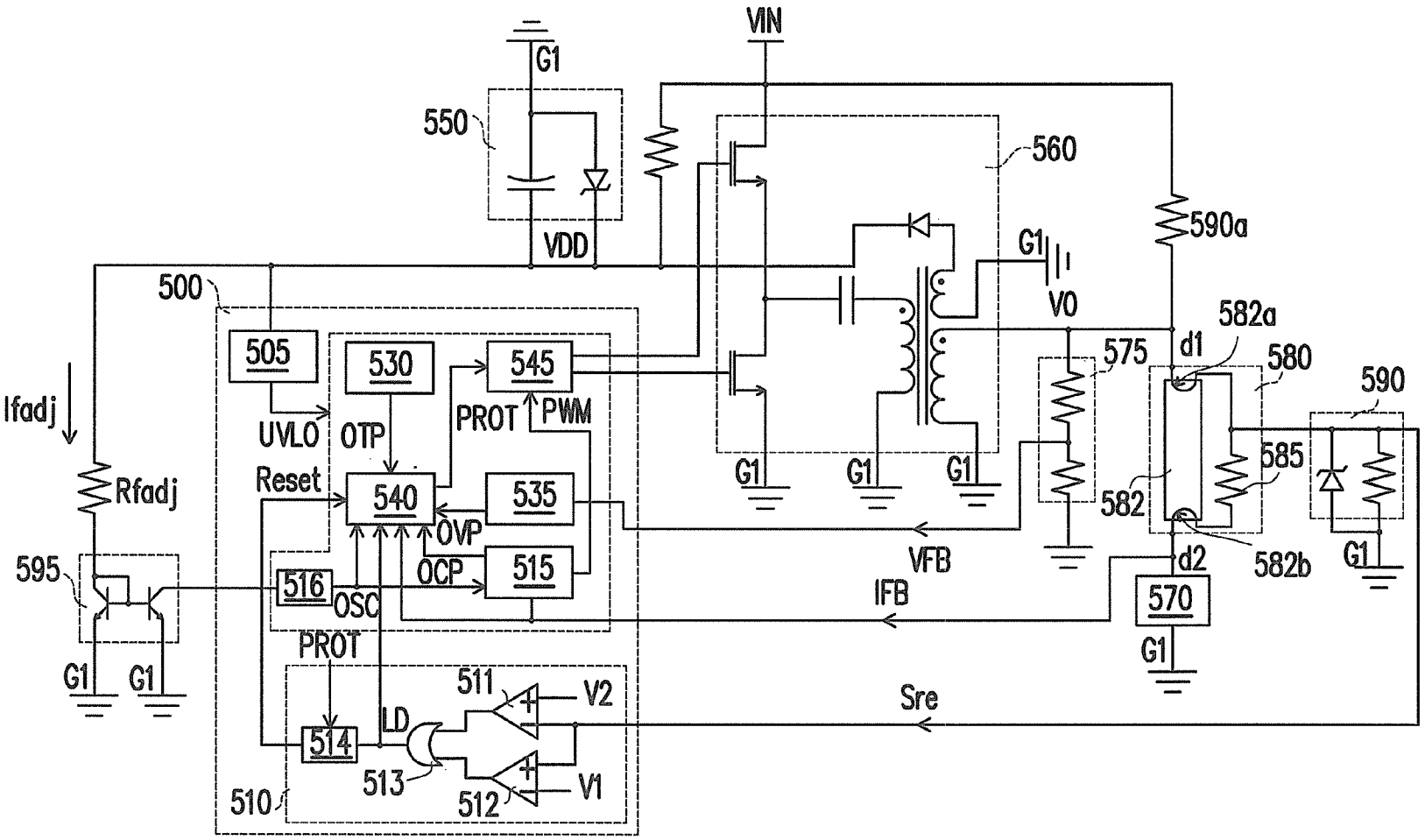
FIG. 6 is a schematic circuit of a power conversion driving circuit according to a fourth embodiment consistent with the invention.

FIG. 6 is a schematic circuit of a power conversion driving circuit according to a fourth embodiment consistent with the invention. The power conversion driving circuit includes a control circuit 500, an input starting circuit 550, a converting circuit 560, a current detecting circuit 570, a voltage detecting circuit 575, a load circuit 580, and a frequency modulating circuit 595. The converting circuit 560 is a DC/AC converting circuit. The primary side of the converting circuit 560 is coupled to a DC input voltage VIN, and the DC input voltage VIN is converted to an AC output voltage VO at the secondary side thereof to drive a fluorescent lamp 582 in the load circuit 580. Moreover, the auxiliary side of the converting circuit 560 provides the electric power to the input starting circuit 550 after being rectified by a diode. The input starting circuit 550 is coupled to the DC input voltage VIN and the auxiliary side of the converting circuit 560. When the power conversion driving circuit does not operate, the power conversion driving circuit receives the electric power from the DC input voltage VIN to provide a driving voltage VDD to the control circuit 500; when the power conversion driving circuit operates, the power conversion driving circuit also receives the electric power from the auxiliary side. The load circuit 580 includes the fluorescent lamp 582 and a load detecting unit 585. The fluorescent lamp 582 has a first filament 582*a* and a second filament 582*b*. One terminal of the first filament 582*a* and one terminal of the second filament 582*b* are coupled through the load detecting unit 585. The other terminal of the first filament 582*a* is respectively coupled to the AC output voltage VO and the DC input voltage VIN through a first connecting terminal d1 and a resister 590*a*, and the other terminal of the second filament 582*b* is grounded through a second connecting terminal d2. The control circuit 500 receives a current detecting signal IFB generated by the current detecting circuit 570 and a voltage detecting signal VFB generated by the voltage detecting circuit 575 to generate control signals to control the converting circuit 560.

The control circuit 500 includes an under voltage lock-out unit 505, a lamp protection re-starting unit 510, a current feedback unit 515, an oscillation unit 516, an over temperature protection unit 530, a voltage feedback unit 535, a protection unit 540, and a driving signal generating unit 545. The control circuit 500 is configured to generate the control signals to control the switches in the converting circuit 560. The under voltage lock-out unit 505 is coupled to the input starting circuit 550 to receive the driving voltage VDD and generates a starting signal UVLO to the current feedback unit 515, the over temperature protection unit 530, the voltage feedback unit 535, a protection unit 540, and a driving signal generating unit 545 when the driving voltage VDD has reached to a predetermined operation voltage, so that these circuit units start to operate.

The current detecting circuit 570 is coupled to the load circuit 580 to detect a load current flowing through the fluorescent lamp and generates a current detecting signal IFB. The voltage detecting circuit 575 is coupled to the converting circuit 560 to detect the output voltage VO and generates a voltage detecting signal VFB. The oscillation unit 516 generates an oscillation signal OSC. During the beginning of the circuit is started, the frequency of the oscillation signal OSC is continuously maintained at a higher frequency for a warm-up period to warm up the fluorescent lamp 582. Thereafter, the frequency is scanned toward a lower operation frequency to turn on the fluorescent lamp 582, and then the frequency is maintained at the operation frequency. The current feedback unit 515 receives the current detecting signal IFB and the oscillation signal OSC to generate a pulse width modulation signal PWM, and the current feedback unit 515 generates an over current protection signal OCP when the load current is higher than a predetermined maximum current. The voltage feedback unit 535 receives the voltage detecting signal VFB and generates an over voltage protection signal OVP when the output voltage VO is higher than a predetermined maximum voltage. The lamp protection re-starting unit 510 is coupled to the load detecting unit 585 to detect whether the first filament 582*a* and the second filament 582*b* of the fluorescent lamp 582 are damaged or whether the fluorescent lamp 582 is removed. If so, the lamp protection re-starting unit 510 generates a lamp protection signal LD. The over temperature protection unit 530 detects the temperature of the control circuit 500 and generates an over temperature protection signal OTP when the temperature is higher than a predetermined maximum temperature. The protection unit 540 is coupled to the oscillation unit 516, the lamp protection re-starting unit 510, the over temperature protection unit 530, the voltage feedback unit 535, and the current detecting circuit 570. When receiving any one of the over voltage protection signal OVP, the over current protection signal OCP, the lamp protection signal LD, and the over temperature protection signal OTP, the protection unit 540 generates a protecting signal PROT to the driving signal generating unit 545 to stop the driving signal generating unit 545 generating the control signal. The driving signal generating unit 545 receives the pulse width modulation signal PWM and accordingly modulates duty cycles of the control signals to control the electric power transmitted from the DC input voltage VIN into the converting circuit 560. As a result, the fluorescent lamp 582 stably emits light. When receiving the protecting signal PROT, the driving signal generating unit 545 instantly stops outputting the control signal until it does not receive the protecting signal PROT. If the abnormal state occurs in the circuit, so that the protection unit 540 constantly receives the over voltage protection signal OVP or the over current protection signal OCP for a predetermined period, or the current detecting signal IFB remains zero for a predetermined period, the protection unit 540 counts time according to the oscillation signal OSC. When determining that the mentioned-above abnormal states occurs in the circuit, the protection unit 540 generates and constantly outputs the protecting signal PROT to stop the control circuit 500 controlling the converting circuit 560. That is, the protection unit 540 latch the control circuit 500 in a protection mode until the control circuit 500 is re-started.

The load circuit 580 is assembled in the power conversion driving circuit. The load detecting unit 585 is coupled to the DC input voltage VIN to generate a load detecting signal Sre. At this time, the voltage level of the load detecting signal Sre stays between a first reference voltage level V1 and a second reference voltage level V2 received by the lamp protection re-starting unit 510, wherein the first reference voltage level V1 is higher than the second reference voltage level V2. When the load circuit 580 is removed or opened because the first filament 582*a* of the fluorescent lamp 582 is damaged, the load detecting signal Sre is grounded through a load detection initial circuit 590, so that the voltage level of the load detecting signal Sre is lower than the second reference voltage level V2. When the fluorescent lamp 582 is opened because the second filament 582*b* of the fluorescent lamp 582 is damaged, the load detecting signal Sre is coupled to the DC input voltage VIN through a resistor 590*a*, so that the voltage level of the load detecting signal Sre is higher than the first reference voltage level V1. The lamp protection re-starting unit 510 includes a first comparator 511, a second comparator 512, an OR gate 513, and a delay circuit 514. The first comparator 511 and the second comparator 512 are configured to compare the load detecting signal Sre with the first reference voltage level V1 and the second reference voltage level V2 to determine whether the load detecting signal Sre stays between the first reference voltage level V1 and the second reference voltage level V2. When the load detecting signal Sre is higher than the first reference voltage level V1 or lower than the second reference voltage level V2, the first comparator 511 or the second comparator 512 generates an output having the high voltage level to the OR gate 513. Accordingly, the OR gate 513 generates the lamp protection signal LD to the protection unit 540, so that the control circuit 500 enters the protection mode.

Moreover, when receiving the protecting signal PROT, the delay circuit 514 is started to determine whether the abnormal state in the fluorescent lamp 582 is removed. When the abnormal state in the fluorescent lamp 582 is removed, the OR gate 513 outputs an signal having the low voltage level. For example, when the users replace a new fluorescent lamp, the abnormal state in the fluorescent lamp 582 is removed. When constantly receiving the output signals having the low voltage level outputted from the OR gate 513 for a predetermined period, the delay circuit 514 generates a re-starting signal Reset to the protection unit 540, so that the protection unit 540 is released from the protection mode, and the control circuit 500 is re-started.

The oscillation unit 516 may coupled to the frequency modulating circuit 595 to modulate the operation frequency of the control circuit 500, i.e. the frequency of the oscillation signal OSC. As shown in FIG. 6, the configuration of the frequency modulating circuit 595 is a current minor. The current mirror includes two bipolar junction transistors (BJT). The bases of the BJTs are connected together, and the emitters thereof are grounded. The BJT of which the base and the collector are connected together is connected to the driving voltage VDD (or other constant voltage sources) through a frequency modulating resister Rfadj, so that a frequency modulating current Ifadj flows through the frequency modulating resister Rfadj, and further the frequency modulating current Ifadj is mirrored to the other BJT. Accordingly, the other BJT outputs the frequency modulating current Ifadj to the oscillation unit 516 to adjust the amount of the charge/discharge current of the oscillation unit 516, thereby changing the frequency of the oscillation signal OSC. The frequency modulating circuit 595 can provide the dimming function. In the present embodiment, the frequency modulating resister Rfadj is a variable resister. The users determines the amount of the frequency modulating current Ifadj by adjusting the resistance of the frequency modulating resister Rfadj, thereby adjusting the operation frequency of the control circuit 500. When the frequency is adjusted higher, the power received by the fluorescent lamp 582 is reduced, and the brightness of the fluorescent lamp 582 is decreased; when the frequency is adjusted lower, the power received by the fluorescent lamp 582 is raised, and the brightness of the fluorescent lamp 582 is increased.

When the frequency modulating circuit 595 is connected to the input voltage VIN, the output power of the power conversion driving circuit can be adjusted with the input voltage VIN. When the input voltage VIN is high, e.g. the high input voltage VIN is provided by rectifying general electricity of 220V, the frequency modulating current Ifadj is raised, so that the frequency is increased to compensate the raised output power of the input voltage VIN. On the contrary, when the input voltage VIN is low, the frequency modulating current Ifadj falls down, so that the frequency is decreased. In the above frequency modulating circuit 595, it is an exemplary that the frequency is adjusted through the charge/discharging current. In practice, the implementation may be changed with the configuration of the oscillation unit 516. For example, for the voltage controlled oscillator (VCO), the voltage levels of the upper and the lower reference voltages of the VCO may be adjusted, or the capacitance for generating the ramp signal thereof may be adjusted.

Accordingly, as described in the above embodiments, the power conversion driving circuit is turned off when the load driven thereby is removed. Therefore, the power consumption of the control circuit is reduced when the abnormal state occurs in the power conversion driving circuit, and the danger to users is also avoided when they use the power conversion driving circuit. Moreover, after load replacing, the power conversion driving circuit is automatically re-started to increase users' convenience.

As the above description, the invention completely complies with the patentability requirements: novelty, non-obviousness, and utility. It will be apparent to those skilled in the art that various modifications and variations can be made to the structure of the invention without departing from the scope or spirit of the invention. In view of the foregoing descriptions, it is intended that the invention covers modifications and variations of this invention if they fall within the scope of the following claims and their equivalents.

What is claimed is:

1. A power conversion driving circuit, comprising:

a converting circuit coupled to an input voltage;

a control circuit coupled to the converting circuit and configured to control the converting circuit to convert the input voltage to an output voltage; and a load circuit comprising a load detecting unit and a load, the load coupled to the output voltage, and the load detecting unit coupled to a detecting voltage source, wherein the load detecting unit generates a load detecting signal to re-start the control circuit when the load circuit is inserted into the power conversion driving circuit.

2. The power conversion driving circuit as claimed in claim 1, wherein the detecting voltage source is the input voltage or the output voltage.

3. The power conversion driving circuit as claimed in claim 2, wherein the converting circuit is a DC/DC converting circuit, the load is a light emitting diode (LED) module, and the control circuit controls the converting circuit according to a voltage detection signal representing the output voltage.

4. The power conversion driving circuit as claimed in claim 3, wherein the control circuit controls the converting circuit further according to a current detection signal representing a load current flowing through the load.

5. The power conversion driving circuit as claimed in claim 4, wherein the control circuit comprises a protecting unit, the protecting unit latches the control circuit on a protection mode to stop the control circuit controlling the converting circuit when the output voltage is higher than a predetermined protection voltage value or when the load current is higher than a predetermined protection current value.

6. The power conversion driving circuit as claimed in claim 5, wherein the protecting unit releases the control circuit from the protection mode when receiving the load detecting signal.

7. The power conversion driving circuit as claimed in claim 2, wherein the converting circuit is a DC/AC converting circuit, the load is a fluorescent lamp, and the control circuit controls the converting circuit according to a voltage detection signal representing the output voltage and a current detection signal representing a load current flowing through the load.

8. The power conversion driving circuit as claimed in claim 7, wherein the control circuit comprises a protecting unit, and the protecting unit latches the control circuit in a protection mode to stop the control circuit controlling the converting circuit when the output voltage is higher than a predetermined protection voltage value, when the load current is higher than a predetermined protection current value, or when the load current is lower than a predetermined current value.

9. The power conversion driving circuit as claimed in claim 8, wherein the protecting unit releases the control circuit from the protection mode when receiving the load detecting signal.

10. The power conversion driving circuit as claimed in claim 1, wherein the load detecting unit and the load are not directly connected.

11. The power conversion driving circuit as claimed in claim 10, further comprising an input starter, wherein the input starter is coupled to the input voltage to generate a driving voltage, and the control circuit is coupled to the driving voltage to receive electric power.

12. The power conversion driving circuit as claimed in claim 1, further comprising a frequency modulating circuit coupled to the input voltage, which changes an operation frequency of the control circuit with the input voltage.

13. A power conversion driving circuit, comprising:

a converting circuit coupled to an input voltage;

a control circuit coupled to the converting circuit and configured to control the converting circuit to convert the input voltage to an output voltage; and a load circuit comprising a load detecting unit and a load, wherein the load is coupled to the output voltage, and the load detecting unit is coupled to a driving voltage source, wherein the control circuit is coupled to the driving voltage source to receive electric power therefrom through the load detecting unit, and the electric power from the driving voltage source is stopped from being provided when the load circuit is removed.

14. The power conversion driving circuit as claimed in claim 13, further comprising an input starter, wherein the input starter is coupled to the input voltage to generate a driving voltage, and the control circuit is coupled to the driving voltage to receive the electric power from the driving voltage.

15. The power conversion driving circuit as claimed in claim 14, wherein the input starter comprises a switch device coupled to the load detecting unit, wherein the switch device is configured to transmit the electric power from the driving voltage source and stops transmitting the electric power when the load circuit is removed.

16. The power conversion driving circuit as claimed in claim 15, wherein the converting circuit comprises a transformer having a primary coil, a secondary coil, and an auxiliary coil, wherein the primary coil is coupled to the input voltage, the secondary coil is coupled to the output voltage, and an auxiliary coil is coupled to the input starter.

17. The power conversion driving circuit as claimed in claim 15, wherein the driving voltage source is the input voltage, and the input starter is coupled to the input voltage through the load detecting unit.

18. The power conversion driving circuit as claimed in claim 13, wherein the load detecting unit and the load are electrically isolated from each other.

19. The power conversion driving circuit as claimed in claim 13, further comprising a frequency modulating circuit coupled to the input voltage, which changes the operation frequency of the control circuit with the input voltage.

20. A driving circuit of a fluorescent lamp, comprising: a converting circuit coupled to an input voltage; a control circuit coupled to the converting circuit and configured to control the converting circuit to convert the input voltage to an output voltage; and a load circuit comprising a load detecting unit and the fluorescent lamp, the fluorescent lamp coupled to the output voltage and having two filaments, and the load detecting unit coupled to the input voltage and a ground voltage through the two filaments and generating a load detecting signal, wherein the control circuit stops operating when an abnormal state occurs in the driving circuit of the fluorescent lamp, and, the control circuit is re-started when detecting that the load detecting signal enters a predetermined voltage range.

21. The driving circuit of the fluorescent lamp as claimed in claim 20, wherein the control circuit comprises a protecting unit, and the protecting unit generates a protection signal to stop an operation of the control circuit when the output voltage is higher than a predetermined protection voltage value, when the load current is higher than a predetermined protection current value, or when the load current is lower than a predetermined current value.

22. The driving circuit of the fluorescent lamp as claimed in claim 21, wherein the control circuit comprises a re-starting unit, and the re-starting unit is started when receiving the protection signal, and next, the re-starting unit generates a re-start signal to re-start the control circuit when detecting that the load detecting signal enters the predetermined voltage range.

23. The driving circuit of the fluorescent lamp as claimed in claim 22, wherein the re-starting unit comprises a delay circuit, and the delay circuit generates the re-start signal when the load detecting signal enters the predetermined voltage range for a predetermined period.

24. The driving circuit of the fluorescent lamp as claimed in claim 20, further comprising a frequency modulating circuit coupled to the input voltage, which changes an operation frequency of the control circuit with the input voltage.

* * * * *